US005582711A

United States Patent [19]

Ellis et al.

[11] Patent Number: 5,582,711

[45] Date of Patent: Dec. 10, 1996

[54] INTEGRATED STAGED CATALYTIC CRACKING AND HYDROPROCESSING PROCESS

[75] Inventors: Edward S. Ellis, Basking Ridge; Ramesh Gupta, Berkeley Heights; Martin G. Bienstock, Succasunna, all of N.J.

[73] Assignee: Exxon Research and Engineering Company, Florham Park, N.J.

[21] Appl. No.: 292,625

[22] Filed: Aug. 17, 1994

[51] Int. Cl.[6] ..... C10G 51/02

[52] U.S. Cl. ..... 208/76; 208/72; 208/74; 208/77; 208/78; 208/80; 208/89; 208/100; 208/57

[58] Field of Search ..... 208/72, 74, 76, 208/77, 78, 80, 89, 100, 57

[56] References Cited

U.S. PATENT DOCUMENTS

| | | | |
|---|---|---|---|
| 2,791,541 | 5/1957 | Thompson | 196/49 |
| 2,953,513 | 9/1960 | Langer | 208/56 |
| 2,956,003 | 10/1960 | Marshall | 208/74 |
| 2,981,674 | 4/1961 | Good | 208/70 |
| 3,287,254 | 11/1966 | Paterson | 208/68 |
| 3,896,024 | 7/1975 | Nace | 208/74 |
| 3,928,172 | 12/1975 | Davis | 208/77 |
| 4,191,635 | 3/1980 | Quick et al. | 208/89 |
| 4,551,229 | 11/1985 | Pecoraro | 208/76 |
| 4,565,620 | 1/1986 | Montgomery et al. | 208/57 |
| 4,585,545 | 4/1986 | Yancey | 208/74 |
| 4,606,810 | 8/1986 | Krambeck | 208/74 |
| 5,152,883 | 10/1992 | Melin et al. | 208/100 |

*Primary Examiner*—Anthony McFarlane
*Assistant Examiner*—Walter D. Griffin
*Attorney, Agent, or Firm*—Richard D. Jordan; James H. Takemoto

[57] ABSTRACT

Disclosed is a catalytic cracking process which includes more than one catalytic cracking reaction step. The process integrates a hydroprocessing step between the catalytic cracking reaction steps in order to maximize olefins production, distillate quality and octane level of the overall cracked product. Preferably, the hydroprocessing step is included between the reaction stages, and a portion of the hydroprocessed products, i.e., a naphtha and mid distillate fraction, is combined with cracked product for further separation and hydroprocessing. It is also preferred that the first catalytic cracking reaction step be a short contact time reaction step.

6 Claims, 1 Drawing Sheet

INTEGRATED STAGED CATALYTIC CRACKING AND HYDROPROCESSING PROCESS

FIELD OF THE INVENTION

This invention relates to a staged catalytic cracking process which includes more than one catalytic cracking reaction step. In particular, this invention relates to a staged catalytic cracking process which integrates a hydroprocessing step between the catalytic cracking reaction steps.

BACKGROUND OF THE INVENTION

Staged catalytic cracking reaction systems have been introduced to improve the overall octane quality of gasoline. In recent times, however, octane problems have been minimized and environmental constraints have had a larger impact on the refiner. As a result, the known staged catalytic cracking processes are not sufficiently effective in concomitantly meeting environmental constraints and maintaining a high quality octane gasoline product.

U.S. Pat. No. 5,152,883 discloses a fluid catalytic cracking unit which includes two catalytic cracking reaction steps in series. After hydrocarbon feed is cracked in a first catalytic cracking reaction step, light hydrocarbon gases and gasoline products are removed from the product stream and the heavier product portion is hydrotreated. Following hydrotreating and further gasoline product removal, the heavier hydrotreated product is cracked in a second catalytic cracking step. The gasoline products are removed and the heavier products are recycled into the hydrotreating process.

Rehbein et al., Paper 8 from *Fifth World Petroleum Progress*, Jun. 1–5, 1959, Fifth World Petroleum Congress, Inc., New York, pages 103–122 (which corresponds to U.S. Pat. No. 2,956,003, Marshall et al.), disclose a two stage catalytic cracking process which uses a short contact time riser as the first stage. The first stage is described as being designed to give 40–50 wt % conversion. The second stage is a dense bed system that is stated as being designed to charge gas oils from the first stage along with a recycle stream to give overall conversions of 63–72 wt %, although the unit is said to have been run at low enough charge rates to achieve total conversions from 65–90 wt %.

As the prior art demonstrates, known catalytic cracking processes which have been integrated with hydrotreating processes are effective in significantly increasing the octane level of the gasoline product. The known systems, however, increase octane by sacrificing the quality of distillates which can be used as diesel or heating oil. In addition, the known processes produce a relatively high quantity of light saturated vapor products as a result of undesirable hydrogen transfer of hydrogen from the heavier cracked products back to lighter olefin products. By minimizing the negative effects of this type of hydrogen transfer, a greater quantity of olefins product can be produced, and these olefins are made available for further conversion into oxygenates and useful polymer materials. It is, therefore, desirable to obtain a catalytic cracking process which maximizes olefins production, distillate quality and octane level.

SUMMARY OF THE INVENTION

In order to overcome problems inherent in the prior art, the present invention provides a catalytic cracking process comprising the continuous steps of (a) contacting a hydrocarbon with cracking catalyst under catalytic cracking conditions forming a first cracked hydrocarbon product; (b) separating from the first cracked hydrocarbon product a gas oil containing bottoms fraction having an initial boiling point of at least 600° F.; (c) hydroprocessing the gas oil containing bottoms fraction under hydroprocessing conditions forming a hydroprocessed product; (d) separating a light ends fraction and a naphtha and mid distillate fraction from the hydroprocessed product, (e) contacting the separated hydroprocessed product with cracking catalyst under catalytic cracking conditions forming a second cracked hydrocarbon product; and, (f) combining the first cracked hydrocarbon product, the second cracked hydrocarbon product, and the naphtha and mid distillate fraction for continued separation and hydroprocessing of the gas oil containing bottoms fraction.

In a preferred embodiment of the invention, the light ends fraction is a $C_4$-hydrocarbon fraction. In addition, the naphtha and mid distillate fraction is a hydrocarbon distillate fraction having a boiling point range within $C_4$ to less than 800° F.

In another preferred embodiment, less than 50 vol % of the first cracked hydrocarbon product formed in step (a) has a boiling point of less than or equal to 430° F. It is further preferred that at least 75 vol % of the combined first and second cracked hydrocarbon products have a boiling point of less than or equal to 430° F.

It yet another preferred embodiment, the catalytic cracking conditions of step (e) include a reaction temperature that is at least equal to that used under the catalytic cracking conditions of step (a). More preferably, the gas oil containing bottoms fraction and the cracking catalyst are contacted at a temperature which is up to 100° F. higher than that used in step (a). More particularly, the hydrocarbon is contacted with the cracking catalyst at a temperature of 900°–1150° F.

In still another preferred embodiment, the hydrocarbon is contacted with a zeolite cracking catalyst for less than five seconds. More preferably, the hydrocarbon is contacted with the zeolite catalyst for 1–2 seconds.

In yet another preferred embodiment of the invention, the gas oil containing bottoms fraction and the cracking catalyst are contacted at a temperature of 950°–1250° F.

BRIEF DESCRIPTION OF THE DRAWING

The present invention will be better understood by reference to the Detailed Description of the Invention when taken together with the attached drawing, wherein.

DETAILED DESCRIPTION OF THE INVENTION

Figure 1:
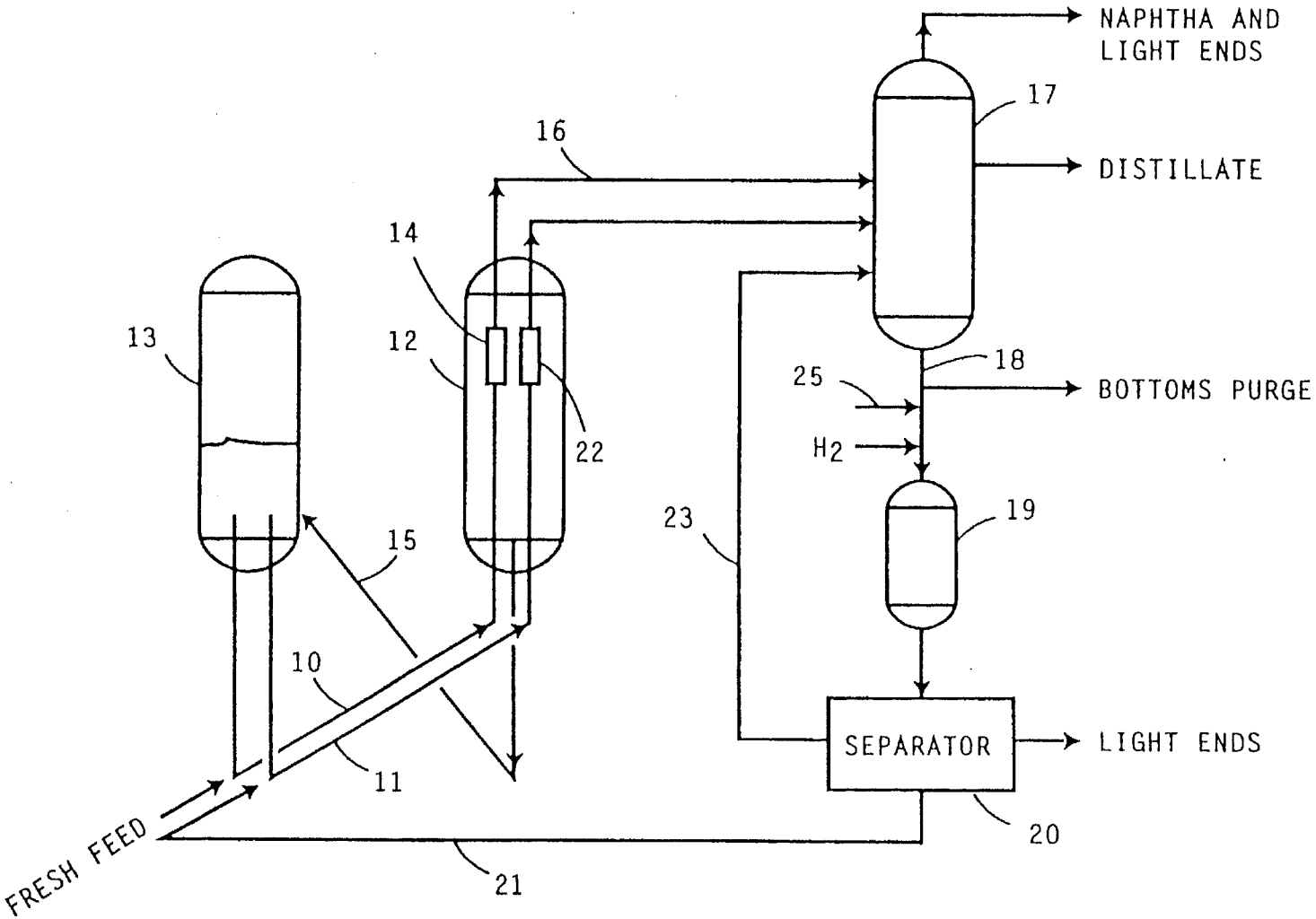
FIG. 1 is a schematic representation of a preferred embodiment of the invention.

Catalytic cracking is a process which is well known in the art of petroleum refining and generally refers to converting at least one large hydrocarbon molecule to smaller hydrocarbon molecules by breaking at least one carbon to carbon bond. For example, a large paraffin molecule can be cracked into a smaller paraffin and an olefin, and a large olefin molecule can be cracked into two or more smaller olefin molecules. Long side chain molecules which contain aromatic rings or naphthenic rings can also be cracked.

It has been found that the quantity of light olefin product and the quality of distillate product that is formed during the catalytic cracking process can be improved by initially incorporating a short contact time reaction step into the overall catalytic cracking process. After the short contact time reaction step, a gas oil containing bottoms fraction is separated from the product portion, and the gas oil containing bottoms fraction is reprocessed at a higher intensity relative to that used in the short contact time reaction step.

According to this invention, product yield and quality are further enhanced by integrating a hydroprocessing step into the staged catalytic cracking process. Preferably, the hydroprocessing step is included between the reaction stages.

As described herein, a staged catalytic cracking process is a catalytic cracking process which includes at least two catalytic cracking reaction steps, preferably performed in series. These reaction steps preferably take place in a fluid catalytic cracking system, which preferably comprises two or more main reaction vessels, two are more riser reactors which connect to one main reaction vessel, or a combination of multiple risers and reactor vessels.

In the catalytic cracking process of this invention, the hydrocarbon feed is preferably a petroleum hydrocarbon. The petroleum hydrocarbon is preferably a hydrocarbon fraction having an initial boiling point of at least about 400° F., more preferably at least about 600° F. As appreciated by those of ordinary skill in the art, such hydrocarbon fractions are difficult to precisely define by initial boiling point since there is some degree of variability in large commercial processes. Hydrocarbon fractions which are included in this range, however, are understood to include gas oils, thermal oils, residual oils, cycle stocks, topped and whole crudes, tar sand oils, shale oils, synthetic fuels, heavy hydrocarbon fractions derived from the destructive hydrogenation of coal, tar, pitches, asphalts, and hydrotreated feed stocks derived from any of the foregoing.

The hydrocarbon feed is preferably introduced into a riser which feeds a catalytic cracking reactor vessel. Preferably, the feed is mixed in the riser with catalytic cracking catalyst that is continuously recycled.

The hydrocarbon feed can be mixed with steam or an inert type of gas at such conditions so as to form a highly atomized stream of a vaporous hydrocarbon-catalyst suspension. Preferably, this suspension flows through the riser into a reactor vessel.

Within the reactor vessel, the catalyst is separated from the hydrocarbon vapor to obtain the desired products, such as by using cyclone separators. The separated vapor comprises the cracked hydrocarbon product, and the separated catalyst contains a carbonaceous material (i.e., coke) as a result of the catalytic cracking reaction.

The coked catalyst is preferably recycled to contact additional hydrocarbon feed after the coke material has been removed. Preferably, the coke is removed from the catalyst in a regenerator vessel by combusting the coke from the catalyst under standard regeneration conditions. Preferably, the coke is combusted at a temperature of about 900°–1400° F. and a pressure of about 0–100 psig. After the combustion step, the regenerated catalyst is recycled to the riser for contact with additional hydrocarbon feed. Preferably, the regenerated catalyst contains less than 0.4 wt % coke, more preferably less than 0.1 wt % coke.

The catalyst which is used in this invention can be any catalyst which is typically used to catalytically "crack" hydrocarbon feeds. It is preferred that the catalytic cracking catalyst comprise a crystalline tetrahedral framework oxide component. This component is used to catalyze the breakdown of primary products from the catalytic cracking reaction into clean products such as naphtha for fuels and olefins for chemical feedstocks. Preferably, the crystalline tetrahedral framework oxide component is selected from the group consisting of zeolites, tectosilicates, tetrahedral aluminophophates (ALPOs) and tetrahedral silicoaluminophosphates (SAPOs). More preferably, the crystalline framework oxide component is a zeolite.

Zeolites which can be employed in accordance with this invention include both natural and synthetic zeolites. These zeolites include gmelinite, chabazite, dachiardite, clinoptilolite, faujasite, heulandite, analcite, levynite, erionite, sodalite, cancrinite, nepheline, lazurite, scolecite, natrolite, offretite, mesolite, mordenite, brewsterite, and ferrierite. Included among the synthetic zeolites are zeolites X, Y, A, L, ZK-4, ZK-5, B, E, F, H, J, M, Q, T, W, Z, alpha and beta, ZSM-types and omega.

In general, aluminosilicate zeolites are effectively used in this invention. However, the aluminum as well as the silicon component can be substituted for other framework components. For example, the aluminum portion can be replaced by boron, gallium, titanium or trivalent metal compositions which are heavier than aluminum. Germanium can be used to replace the silicon portion.

The catalytic cracking catalyst used in this invention can further comprise an active porous inorganic oxide catalyst framework component and an inert catalyst framework component. Preferably, each component of the catalyst is held together by attachment with an inorganic oxide matrix component.

The active porous inorganic oxide catalyst framework component catalyzes the formation of primary products by cracking hydrocarbon molecules that are too large to fit inside the tetrahedral framework oxide component. The active porous inorganic oxide catalyst framework component of this invention is preferably a porous inorganic oxide that cracks a relatively large amount of hydrocarbons into lower molecular weight hydrocarbons as compared to an acceptable thermal blank. A low surface area silica (e.g., quartz) is one type of acceptable thermal blank. The extent of cracking can be measured in any of various ASTM tests such as the MAT (microactivity test, ASTM # D3907-8). Compounds such as those disclosed in Greensfelder, B. S., et al., *Industrial and Engineering Chemistry*, pp. 2573–83, November 1949, are desirable. Alumina, silica-alumina and silica-alumina-zirconia compounds are preferred.

The inert catalyst framework component densities, strengthens and acts as a protective thermal sink. The inert catalyst framework component used in this invention preferably has a cracking activity that is not significantly greater than the acceptable thermal blank. Kaolin and other clays as well as α-alumina, titania, zirconia, quartz and silica are examples of preferred inert components.

The inorganic oxide matrix component binds the catalyst components together so that the catalyst product is hard enough to survive interparticle and reactor wall collisions. The inorganic oxide matrix can be made from an inorganic oxide sol or gel which is dried to "glue" the catalyst components together. Preferably, the inorganic oxide matrix will be comprised of oxides of silicon and aluminum. It is also preferred that separate alumina phases be incorporated into the inorganic oxide matrix. Species of aluminum oxyhydroxides-g-alumina, boehmite, diaspore, and transitional aluminas such as α-alumina, β-alumina, γ-alumina, δ-alumina, ϵ-alumina, κ-alumina, and ρ-alumina can be employed. Preferably, the alumina species is an aluminum trihydroxide such as gibbsite, bayerite, nordstrandite, or doyelite.

In the staged catalytic cracking process incorporated into this invention, hydrocarbon feed is subjected to a first catalytic cracking reaction step, at least a portion of the product of the first reaction step is separated, and the separated portion is subjected to at least one additional catalytic cracking reaction step. Separation is preferably achieved using known distillation methods.

According to this invention, after a hydrocarbon feed undergoes the first catalytic cracking reaction step, it is preferable to separate a gas oil containing bottoms fraction from the product of the cracking reaction. The gas oil containing fraction is preferably a petroleum distillate fraction having an initial boiling point of at least 600° F., more preferably at least 650° F. The gas oil containing bottoms fraction is then used as the feed for at least one subsequent catalytic cracking reaction step. The remaining product portion of the first catalytic cracking reaction is sent to storage or subjected to further processing in other refinery processing units.

It is preferred in this invention that the gas oil containing bottoms fraction be hydroprocessed prior to being subjected to any additional catalytic cracking steps. The gas oil containing bottoms fraction is hydroprocessed by passing the fraction over a hydroprocessing catalyst in the presence of a hydrogen containing gas under hydroprocessing condition.

As used herein, hydroprocessing includes both hydrotreating and mild hydrocracking, with mild hydrocracking indicating that sufficient cracking of 650° F.+feed has occured such that there is a yield of greater than 15 wt % and less than 50 wt % of 650° F.-hydrocarbon material from the cracking reaction. As is known by those of skill in the art, the degree of hydroprocessing can be controlled through proper selection of catalyst as well as by optimizing operation conditions.

It is particularly desirable in this invention that the hydroprocessing step sufficiently saturate the aromatics to more easily form crackable naphthenes. It is also desirable that the hydroprocessing step convert unsaturated hydrocarbons such as olefins and diolefins to paraffins using a typical hydrogenation catalyst. Objectionable elements can also be removed by the hydroprocessing reaction. These elements include sulfur, nitrogen, oxygen, halides, and certain metals.

The hydroprocessing step of the invention is performed under standard hydroprocessing conditions. Preferably, the reaction is performed at a temperature of 400°–900° F., more preferably 600°–850° F. The reaction pressure is preferably 100–3000 psig, more preferably 500–2000 psig. The hourly space velocity is preferably 0.1–6 V/V/Hr, more preferably 0.3–2 V/V/Hr, where V/V/Hr is defined as the volume of oil per hour per volume of catalyst. The hydrogen containing gas is preferably added to establish a hydrogen charge rate of 500–15,000 standard cubic feet per barrel (SCF/B), more preferably 1000–5000 SCF/B.

The catalyst used in the hydroprocessing step can be any conventional hydroprocessing catalyst suitable for aromatic saturation, desulfurization, denitrogenation or any combination thereof. Preferably, the catalyst is comprised of at least one Group VIII metal and a Group VI metal on an inorganic refractory support, which preferably alumina or alumina-silica. The Group VIII and Group VI compounds are well known to those of ordinary skill in the art and are well defined in the Periodic Table of the Elements. For example, these compounds are listed in the Periodic Table found at the last page of *Advanced Inorganic Chemistry,* 2nd Edition 1966, Interscience Publishers, by Cotton and Wilkenson.

The Group VIII metal is preferably present in an amount ranging from 2–20 wt %, preferably 4–12 wt %. Preferred Group VIII metals include Co, Ni, and Fe, with Co and Ni being most preferred. The preferred Group VI metal is Mo which is present in an amount ranging from 5–50 wt %, preferably 10–40 wt %, and more preferably from 20–30 wt %.

All metals weight percents given are on support. The term "on support" means that the percents are based on the weight of the support. For example, if a support weighs 100 g, then 20 wt % Group VIII metal means that 20 g of the Group VIII metal is on the support.

Any suitable inorganic oxide support material may be used for the catalyst of the present invention. Preferred are alumina and silica-alumina, including crystalline aluminosilicate such as zeolite. More preferred is alumina. The silica content of the silica-alumina support can be from 2–30 wt %, preferably 3–20 wt %, more preferably 5–19 wt %. Other refractory inorganic compounds may also be used, non-limiting examples of which include zirconia, titania, magnesia, and the like. The alumina can be any of the aluminas conventionally used for hydroprocessing catalysts. Such aluminas are generally porous amorphous alumina having an average pore size from 50–200 Å, preferably, 70–150 Å, and a surface area from 50–450 $m^2/g$.

In the staged catalytic cracking process of this invention, a short contact time reaction step is preferably included. In the short contact time reaction step, it is preferable that the hydrocarbon feed contacts the cracking catalyst under catalytic cracking conditions to form a first cracked hydrocarbon product, and the catalytic cracking conditions are controlled so that less than 50 vol % of the first cracked hydrocarbon product has a boiling point below about 430° F. More preferably, catalytic cracking conditions are controlled so that 25–40 vol % of the first cracked hydrocarbon product has a boiling point equal to or below about 430° F.

The 430° F. boiling point limitation is not per se critical, but is used to give a general indication of the amount of gasoline and high quality distillate type products that are formed in the short contact time reaction step. In the short contact time reaction step, therefore, it is desirable to initially limit the conversion to gasoline and high quality distillate type products. By controlling the conversion in this step, hydrogen transfer can be positively affected in any subsequent cracking step.

According to this invention, short contact time means that the hydrocarbon feed will contact the cracking catalyst for less than five seconds. In typical fluid catalytic cracking systems this means that the vapor residence time will be less than five seconds. Preferably, in the short contact time reaction step, the hydrocarbon feed will contact the cracking catalyst for 1–4 seconds.

The short contact time reaction step can be achieved using any of the known processes. For example, in one embodiment a close coupled cyclone system effectively separates the catalyst from the reacted hydrocarbon to quench the cracking reaction. See, for example, Exxon's U.S. Pat. No. 5,190,650, of which the detailed description is incorporated herein by reference.

Short contact time can be achieved in another embodiment by injecting a quench fluid directly into the riser portion of the reactor. The quench fluid is injected into the appropriate location to quench the cracking reaction in less than one second. See, for example, U.S. Pat. No. 4,818,372, of which the detailed description is incorporated herein by reference. Preferred as a quench fluid are such examples as water or steam or any hydrocarbon that is vaporizable under conditions of injection, and more particularly the gas oils from coking or visbreaking, catalytic cycle oils, and heavy aromatic solvents as well as certain deasphalted fractions extracted with a heavy solvent.

In yet another embodiment, short contact time can be achieved using a down flow reactor system. In downflow reactor systems, contact time between catalyst and hydrocarbon can be as low as in the millisecond range. See, for example, U.S. Pat. Nos. 4,985,136, 4,184,067 and 4,695,370, of which the detailed descriptions of each are incorporated herein by reference.

The particular catalytic cracking conditions used to achieve conversion to a product in which less than 50 vol % of the product has a boiling point less than 430° F. are readily obtainable by those of ordinary skill in the art. Once the preferred particular cracking catalyst is chosen, the operations parameters of pressure, temperature and vapor residence time are optimized according to particular unit operations constraints. For example, if it is desired to use a zeolite type of cracking catalyst, the short contact time reaction step will typically be carried out at a pressure of 0–100 psig (more preferably 5–50 psig), a temperature of 900°–1150° F. (more preferably 950°–1100° F.) and a vapor residence time of less than five seconds (more preferably 2–5 seconds).

Regardless of the type of quenching step used to achieve the short contact time reaction, the catalyst is separated from the vapor to obtain the desired products according to the known processes, such as by using cyclone separators. The separated vapor comprises the cracked hydrocarbon product, and the separated catalyst contains a carbonaceous material (i.e., coke) as a result of the catalytic cracking reaction.

The products recovered from the short contact time reaction step are preferably separated so that a gas oil containing bottoms fraction is recovered for hydroprocessing and additional cracking. Preferably, the gas oil containing bottoms fraction contains a distillate having an initial boiling point of at least 600° F., more preferably an initial boiling point of at least 650° F.

After the gas oil containing bottoms fraction is separated, it is preferably hydroprocessed and then subjected to at least one subsequent cracking step with a cracking catalyst under catalytic cracking conditions which favor cracking of the heavier hydrocarbons contained in the bottoms fraction. It is preferred in any subsequent cracking step following the hydroprocessing step that the reaction time be longer and the reaction temperature be at least equal to that used in the short contact time reaction step. The appropriate catalytic cracking conditions employed following the short contact time reaction step are preferably controlled so that the combined products of all of the cracking steps will yield an overall product in which at least 75 vol %, preferably at least 85 vol %, of the overall product has a boiling point of less than or equal to about 430° F.

In any cracking steps following the hydroprocessing step, the conditions which are used to achieve the desired overall product boiling point characteristics are readily obtainable by those of ordinary skill in the art and are optimized according to the needs of the specific operating unit. Since the same catalyst is generally used in the short contact time reaction step as in a subsequent cracking reaction step, it is preferred to increase slightly the severity of the reaction conditions in the subsequent reaction step. Preferably, this is done by increasing the vapor contact time in the subsequent reaction step, while maintaining reaction temperatures and pressures similar to that in the short contact time step, although reaction temperatures and pressures can be adjusted without changing vapor contact time. For example, when using a zeolite type of cracking catalyst, it is preferred to have a vapor residence time of less than 10 seconds, more preferably a vapor residence time of 2–8 seconds.

Depending upon the quality of the feed and the particular reaction equipment used, however, it can be desirable to increase the temperature of a subsequent catalytic cracking reaction step. Preferably, any temperature increase will be less than about 100° F. higher than in the short contact time reaction step and in a range of about 950°–1250° F.

Although it is preferred to slightly increase the severity of any cracking reaction subsequent to the initial short contact time reaction step, this is not necessary. In general, the more intense the hydroprocessing step, the less intense can be any subsequent cracking steps.

A preferred embodiment of the invention is shown in FIG. 1 in which the cracking reaction is carried out using dual risers 10, 11 and a single reactor 12, with the spent catalyst being regenerated in a single regenerator 13. Although a dual riser with single reactor design is shown as one preferred embodiment, the process of this invention can be carried out using more than one reactor or more than two risers.

In FIG. 1, fresh hydrocarbon feed is injected into the riser 10 where it contacts hot catalyst from the regenerator 13. The reaction is preferably quenched using a cyclone separator 14 to separate the hydrocarbon material from the spent catalyst. The spent catalyst falls through a stripper and standpipe and is carried through a return line 15 to the regenerator 13 where it is regenerated for further use.

Cracked hydrocarbon product is removed from the cyclone 14 by way of a line 16 which leads to a separation vessel 17. The separation vessel 17 is used to separate a relatively heavy gas oil containing bottoms fraction from a naphtha and light ends fraction and a high quality distillate fraction. As stated above, operating conditions within the riser 10 are maintained such that less than 50 vol % of the cracked hydrocarbon product from riser 10 has a boiling point of less than or equal to 430° F.

The gas oil containing bottoms fraction is removed from the separation vessel by way of a line 18, and a portion of the bottoms fraction is removed as a purge stream. As the gas oil containing bottoms fraction is transported through line 18, a hydrogen containing gas stream is injected at the desired rate, and the entire mixture is sent to a hydroprocessing reactor 19. The hydroprocessing reactor 19 contains a standard hydroprocessing catalyst and the hydroprocessing reaction is carried out under standard conditions.

Following the hydroprocessing reaction, a light ends fraction and a naphtha and mid distillate fraction are separated from the hydroprocessed product in a separator 20. The light ends fraction is a $C_4$-hydrocarbon fraction, e.g., a hydrocarbon fraction containing C4 and lighter hydrocarbons and other gases boiling below about 100° F. including excess hydrogen from the hydroprocessing reaction. The naphtha and mid distillate fraction includes a hydrocarbon fraction preferably within a boiling point range of $C_4$ to less than 800° F. The separator 20 can be any type of separation equipment capable of effectively separating the hydroprocessed product into its component parts. For example, separator 20 can be a simple fractionator or could be a series of collection vessels such as a hot separator vessel followed by a cold separator vessel. In such a case, the cold separator liquid would comprise inter alia, a hydrotreated naphtha and distillate stream, and the hot separator liquid would comprise a hydrotreated gas oil containing bottoms stream.

After separation, the hydroprocessed gas oil containing bottoms fraction is injected into riser 11 for further catalytic cracking through a line 21. The cracking reaction in riser 11 is quenched by separating the cracked products from the spent catalyst using a cyclone separator 22. The spent catalyst is combined with the spent catalyst that is separated using the cyclone separator 14, and is sent through the return line 15 to the regenerator 13 where it is regenerated for further use. The cracked product is sent to the separator 17 where it is combined with the cracked product from cyclone separator 14.

The naphtha and mid distillate fraction, which is separated from the hydroprocessed gas oil bottoms fraction in separator 20, is sent to the separator 17 by a line 23 where it is combined with the cracked products from cyclone separators 14 and 22. The separation vessel 17 is used to continuously separate the relatively heavy gas oil containing bottoms fraction from the naphtha and light ends fraction and the high quality distillate fraction as described above.

By recycling the naphtha and distillate stream from the separator 20 back to separator 17, a high value desulfurized naphtha and distillate stream is produced in the hydrotreating reaction, and the high value stream can be recovered without using a separate fractionator. The light ends stream which is separated at separator 20 can be purged from the unit or recycled back to the hydroprocessing reactor 19.

Because the hydroprocessing step removes undesirable contaminants and improves the quality of the feed to the riser 11, other petroleum distillate fractions can be combined with the gas oil containing bottoms fraction prior to hydroprocessing such as by line 25. These other petroleum distillate fractions include petroleum fractions which are generally high in contaminant content, and would not be typically processed in a catalytic cracking reactor. An example of such petroleum distillate fractions includes heavy coker oil streams.

Having now fully described this invention, it will be appreciated by those skilled in the art that the invention can be performed within a wide range of parameters within what is claimed.

What is claimed is:

1. A catalytic cracking process for producing high quality mid distillates consisting essentially of the continuous steps of:

(a) contacting a hydrocarbon having an initial boiling point of at least about 400° F. with cracking catalyst under catalytic cracking conditions wherein the temperature is from 900°–1150° F. and the catalyst contact time is less than five seconds forming a first cracked hydrocarbon product;

(b) conducting the first cracked hydrocarbon product to a first separator and separating from the first cracked hydrocarbon product an overhead naphtha and light ends fraction, a mid distillate fraction and a gas oil containing bottoms fraction having an initial boiling point of at least 600° F.;

(c) conducting the gas oil containing bottoms fraction to a hydroprocessor and hydroprocessing the gas oil containing bottoms fraction under hydroprocessing conditions forming a hydroprocessed product;

(d) conducting the hydroprocessed product to a second separator and separating a light ends fraction, a naphtha and mid distillate fraction and a hydroprocessed gas oil containing bottoms fraction;

(e) contacting the hydroprocessed gas oil containing bottoms fraction with cracking catalyst under catalytic cracking conditions wherein the temperature is from 950°–1250° F. forming a second cracked hydrocarbon product; and (f) combining the first cracked hydrocarbon product from step (a), the second cracked hydrocarbon product from step (e), and the naphtha and mid distillates fraction from step (d) in the first separator for continued separation and hydroprocessing of the gas oil bottoms fraction.

2. The catalytic cracking process of claim 1, wherein the light ends fraction is a $C_4$- hydrocarbon fraction.

3. The catalytic cracking process of claim 1, wherein less than 50 vol % of the first cracked hydrocarbon product formed in step (a) has a boiling point of less than or equal to 430° F.

4. The catalytic cracking process of claim 1, wherein at least 75% vol. % of the first and second cracked hydrocarbon products have an overall boiling point of less than or equal to 430° F.

5. The catalytic cracking process of claim 1, wherein the catalytic cracking conditions of step (e) include a reaction temperature that is at least equal to that used under the catalytic cracking conditions of step (a).

6. The catalytic cracking process of claim 1, wherein the hydrocarbon is contacted with the zeolite catalyst for 1–2 seconds.

* * * * *